United States Patent [19]

Grombone et al.

[11] 4,419,010

[45] Dec. 6, 1983

[54] METHOD FOR CONTROLLING THE TONER CONCENTRATION IN AN ELECTROSTATIC COPIER

[75] Inventors: Anthony Grombone, Lafayette; George W. Van Cleave, Boulder, both of Colo.

[73] Assignee: International Business Machines Corporation, Armonk, N.Y.

[21] Appl. No.: 357,004

[22] Filed: Mar. 11, 1982

[51] Int. Cl.[3] ..... G03G 15/06; G03G 21/00

[52] U.S. Cl. ..... 355/133; 355/3 DD; 355/14 D

[58] Field of Search ..... 355/3 R, 3 DD, 14 D, 355/14 CH, 133

[56] References Cited

U.S. PATENT DOCUMENTS

| | | | |
|---|---|---|---|
| 4,178,095 | 12/1979 | Champion et al. | 355/14 R |
| 4,286,866 | 9/1981 | Stelben et al. | 355/14 D |
| 4,312,589 | 1/1982 | Brannan et al. | 355/14 CH |
| 4,372,672 | 2/1983 | Pries | 355/14 D X |

*Primary Examiner*—Fred L. Braun

*Attorney, Agent, or Firm*—Francis A. Sirr

[57] ABSTRACT

The toner concentration of a xerographic reproduction device is maintained by use of a patch sensor, wherein the photoconductor's test patch is toned while the photoconductor voltage is substantially zero, and while the developing field is provided by a development electrode voltage source whose polarity is opposite that which is used during reproduction.

3 Claims, 2 Drawing Figures

METHOD FOR CONTROLLING THE TONER CONCENTRATION IN AN ELECTROSTATIC COPIER

TECHNICAL FIELD

This invention relates to xerography and to improving copy quality by controlling toner concentration.

BACKGROUND OF THE INVENTION

A number of schemes for maintaining toner concentration can be found in the prior art. One class of device, to which the present application pertains, is called a patch sensing device. In devices of this class, the optical density of a toned test patch is used as a measure of toner concentration. If this optical density is found to be too low, toner is added to the developer station.

A particularly good device of this class is shown in U.S. Pat. No. 4,178,095 from which FIG. 2 of the present application is taken. This patent is hereby incorporated by reference for the purpose of indicating the xerographic background of the invention, and as illustrative of the state of the art.

A light emitting diode (LED 33 of FIG. 2) is electrically energized at a low level when its reflected light is used to "look at" bare, untoned photoconductor, and is electrically energized at a higher level when its reflected light is used to "look at" a less-reflective toned test patch. The level of higher LED energization is factory-adjusted such that photocell 34, which views these two photoconductor areas, detects substantially the same intensity reflected light when toner concentration is correct. As exemplary correct toner concentration is 1 wt. % toner in a toner/carrier mix which constitutes 100 wt. %.

This patent discloses a potentiometer P1 whose adjustment is operable to attain the correct toner concentration control point by way of a change in the magnitude of said higher LED energization. For example, if this level of energization is increased, more light is reflected from a given optical density toned test patch. As a result, the control apparatus operates to add toner to the developer mix, and future addition of toner occurs at a higher optical density which is caused by the higher toner concentration control point.

The prior art recognizes that the optical density of a toner image, be it on the photoconductor itself or after the toner image has been transferred from the photoconductor to copy substrate such as paper, is a function of three variables; i.e. (1) the toner concentration in the developer's mixture of toner and carrier beads, (2) the image voltage carried by the photoconductor, this in turn being a function of initial photoconductor charge magnitude, and (3) the magnitude of development electrode bias voltage, for example the voltage applied to the magnetic brush roller of a magnetic brush developer.

THE INVENTION

The present invention improves upon that class of toner concentration control devices known as patch sensors, i.e. those devices that control toner concentration by responding to the optical density of a toned test patch.

The present invention provides an apparatus and method which provides control of toner concentration independent of operation of photoconductor charge, since photoconductor charge is substantially zero during operation of the present invention.

More specifically, and in accordance with the present invention, toner concentration is adjusted with the photoconductor's patch image area at substantially zero voltage. The developer's development electrode voltage is changed, both in magnitude and polarity, such that the development electrostatic field vector used to produce the toned test image patch is of a reproduction-mode magnitude and polarity, but it now exists due solely to the accurate development electrode bias, and most importantly it does not include a sometime unknown photoconductor charge voltage, as in the prior art.

In this way, toner concentration is adjusted with an accurate reproduction-mode development electrostatic field, independent of what may in fact be an improper magnitude of photoconductor charge which occurs during reproduction.

Once toner concentration has been properly adjusted in accordance with the present invention, normal operating magnitudes and polarities of photoconductor charge and development electrode voltage are reinstituted for actual reproduction of copying.

The present invention contemplates either manual or automatic means to implement the invention. The manual means is perhaps most useful in low cost xerographic reproduction devices. Since all reproduction devices require periodic maintenance, it is within the teachings of the present invention to provide a control function whereby the device is placed in a service mode of operation which inhibits charging of the photoconductor, while at the same time changes the developing station's development electrode voltage as aforesaid.

The serviceman then runs at least one copy. The optical density of this copy is compared to a standard provided by the manufacturer of the reproduction device. If the optical density is low, the rate at which toner is automatically added, in weight units of toner per copy, is increased. If optical density is high, the addition of toner per copy is decreased.

Automatic means of implementing the present invention utilizes light reflected from a toned test patch, either on the photoconductor, or after this toner has been transferred to a copy substrate.

The means of aforesaid U.S. Pat. No. 4,178,095 can be used to observe the optical density of a photoconductor test patch, whereas the print density control system of the IBM 3800 printing subsystem can be used to measure the optical density of a toned test patch which has been transferred to paper. In either event, a service mode of operation, wherein photoconductor charge is substantially zero, and the development field is provided entirely by changing both the polarity and magnitude of the development electrode voltage, is utilized to adjust toner concentration.

BRIEF DESCRIPTION OF THE DRAWINGS

FIG. 1 teaches the present invention. The left-hand portion of this figure, labeled "reproduction mode" shows in scalar form the negative 850 volts to which a copier's photocondutor is charged by the copier's gridded charge corona. When light is reflected off a white sheet of paper bearing a black image, onto the photocondctor, the photoconductor forms an electrostatic, reverse-reading latent image whose black-image portion retains the original photoconductor charge (or very nearly so), whereas the photoconductor's white-image portion is substantially completely discharged (here shown as −30 volts).

The copier's developer bias voltage source provides a −350 volts development electrode bias onto the metal roller of a magnetic brush developer. Thus, a positively charged toner particle at the developing nip (that is, the space between this metal roller and the photoconductor's black-image portion) is subjected to a development electrostatic field of −500 volts. This negative-going voltage gradient extends from the metal roller to the photoconductors's black-image portion. Thus, this photoconductor portion is coated with toner, i.e., developed into a reverse-reading visible toner image.

This reproduction mode of operation is a general representation of prior art patch sensor toner concentration apparatus wherein the toned test patch is of the indicated "dark voltage" (or perhaps a lesser magnitude "gray" voltage). The optical density of this toned patch area is taken to be a measure of toner concentration within the copier's developing station. Note that this prior art means of measuring is only as accurate as the magnitude of the indicated "dark voltage" is a known quantity.

Figure 1:
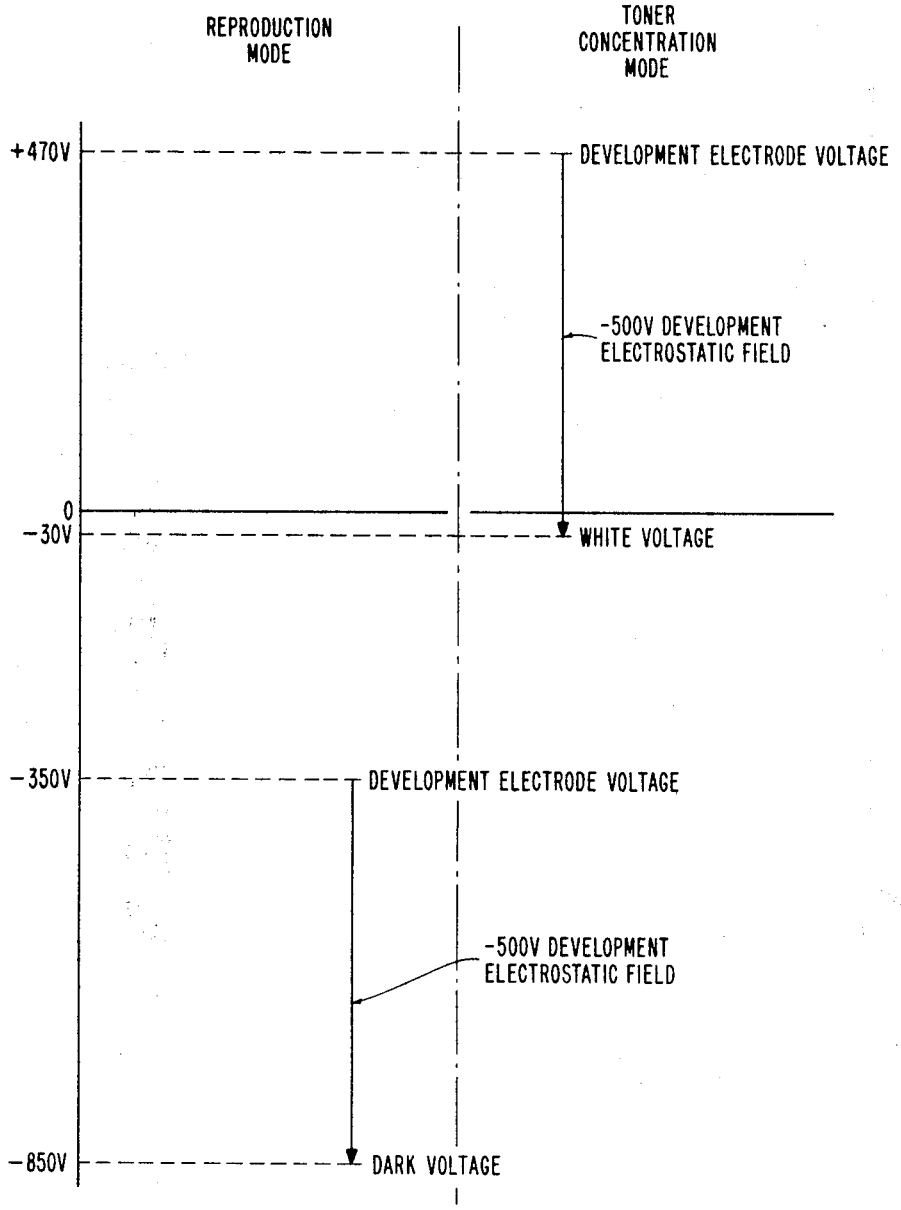
FIG. 1 shows the method steps and modes used to carry out the method steps of the present invention.

FIG. 1 shows as the right-hand portion thereof the toner concentration mode of operation of the present invention. This is not a reproduction mode of operation. Rather, it is a cycle of operation, designated as "toner concentration mode", during which reproduction does not take place. In this case the photoconductor's test patch which is to be toned carries little or no charge. For example, the gridded charge corona is disabled during this mode of operation. In the alternative, if the charge corona is operative, the copier's interimage erase lamp is turned on to discharge the photoconductor. In this case, the photoconductor's test patch area carries a very low magnitude voltage, substantially zero, labeled "white voltage" in the figure.

As the photoconductor's test patch area arrives at the development nip, the polarity and magnitude of the magnetic brush developer's development electrode voltage is switched from −350 volts to +470 volts. As can be seen from the figure, the +470 volts bias provides the same −500 volts development electrostatic field as is used in the reproduction mode. However, in this case the magnitude of the field does not vary as a function of photoconductor charge. After extended operation of a copier, the magnitude of photoconductor charge can be a relatively unknown quantity. However, the +470 volts development electrode voltage is provided by an accurate power supply and is a known quantity. Thus, in accordance with the present invention the optical density of the resulting toned test patch is an accurate measure of toner concentration.

Figure 2:
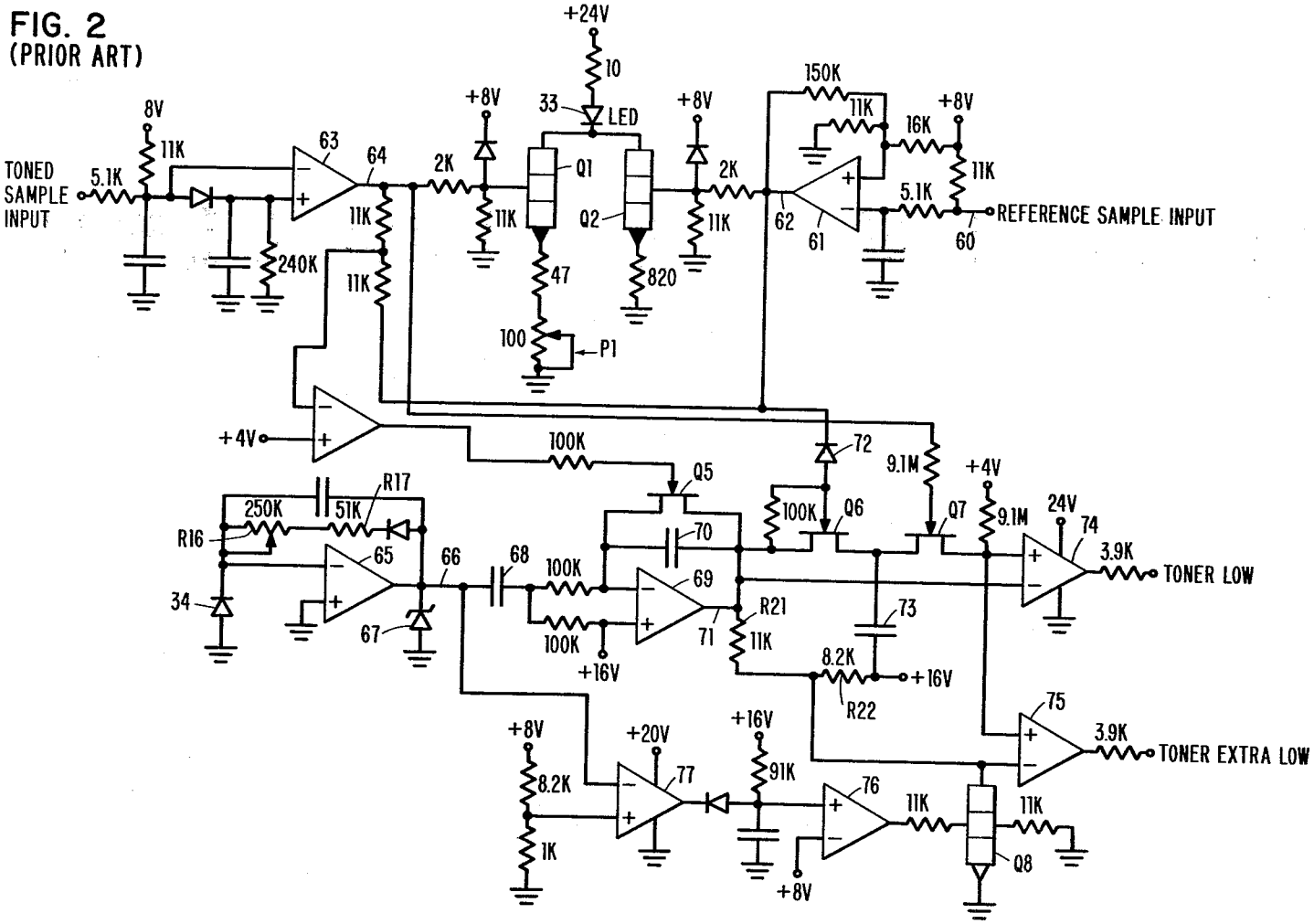
FIG. 2 (PRIOR ART)
FIG. 2 shows the prior art circuit which is used to perform the toner-concentration mode of the present invention in accordance with FIG. 1.

FIG. 2, which is taken from aforementioned U.S. Pat. No. 4,178,095 is a particularly good patch sensor to be used to compare the reflection off an untoned photoconductor area, to the reflection off the above-described toned test patch formed in accordance with the FIG. 1 toner-concentration-mode of the present invention.

The untoned photoconductor area, as described in this patent and as considered by the present invention, is any area of the discharged photoconductor which passed through the development nip while the development electrode voltage was −350 volts. As can be readily appreciated, the resulting development electrostatic field of −300 volts is a positive voltage gradient from the developer's metal roller to the photoconductor, and positive toner therefore does not deposit on the photoconductor.

The toned photoconductor area is, however, produced as above described, using the toner concentration mode of operation of FIG. 1.

If the optical density of the toned test patch produced in accordance with the present invention is too low, toner is added, and further copier cycles in the toner concentration mode of operation are repeated until the correct toner concentration is achieved.

Once the correct toner concentration is achieved, by operation of the present invention, the copier is switched back to the FIG. 1 reproduction mode.

Reference can be had to U.S. Pat. No. 4,178,095 for a detailed description of the operation of FIG. 2. Briefly, LED 33 is used to illuminate the photoconductor's toned test patch, and then a bare area of the photoconductor—as the "toned sample input" or the "reference sample input" are enabled, respectively. These two input signals operate to turn-on transistors Q1 and Q2, respectively. As can be seen, the electrical energization of the LED, and thus its light output, is higher when transistor Q1 is conducting, than when transistor Q2 is conducting, due to the different value of the transistor emitter resistors.

The 100-ohm potentiometer P1, in the emitter circuit of transistor Q1, is factory adjusted, when toner concentration is proper, to produce equal light reflection to photocell 34 from the relatively nonreflective toned test patch and from the relatively reflective bare photoconductor.

Thereafter, during copier operation, when the toned test patch has too high a reflectance (too low an optical density), the "toner low" signal is enabled, and toner is added to the copier's magnetic brush developer. As a result the toned test patch becomes less reflective (during subsequent "toner concentration mode" cycles of FIG. 1) and the toner concentration is restored (increased) to the proper magnitude.

While the invention has been particularly shown and described with reference to preferred embodiments thereof, it will be understood by those skilled in the art that various changes in form and details may be made therein without departing from the spirit and scope of the invention.

What is claimed is:

1. A method for maintaining toner concentration in an electrophotographic reproduction machine which includes photoconductor charging means operable to establish a reproduction photoconductor charge of a first polarity, and developer means including a reproduction development electrode voltage of said first polarity and of a magnitude less than the photoconductor charge, wherein the toning of the photoconductor's latent image results from a development electrostatic field whose magnitude is the magnitude of the photoconductor's latent image voltage minus the magnitude of said development electrode voltage, comprising the ordered steps of:

(a) reducing said photoconductor charge substantially to zero;

(b) changing the polarity and the magnitude of said development electrode voltage in a manner to establish an electrostatic field substantially identical to said development electrostatic field, but with the resulting toning of said photocondutor being substantially independent of photoconductor charge; and (c) measuring the optical density resulting from said toning of said photoconductor in step (b), and increasing toner concentration in said developer only if said optical density is too low.

2. The method of claim 1 including the step of:

(d) repeating steps (a) through (c) until a desired toner concentration is achieved, as this concentration is represented by the optical density measured in step (c).

3. The method of claim 2 including the step of:

establishing said reproduction photoconductor charge and reproduction development electrode voltage when said desired toner concentration has been established by operation of steps (a) through (d).

* * * * *